United States Patent [19]

Varatta

[11] Patent Number: 4,826,457

[45] Date of Patent: May 2, 1989

[54] CLAMP FOR BATTERY BOOSTER CABLE

[75] Inventor: Thomas R. Varatta, Greenville, R.I.

[73] Assignee: Carol Cable Company, Inc., Pawtucket, R.I.

[21] Appl. No.: 199,856

[22] Filed: May 26, 1988

[51] Int. Cl.[4] ..... H01R 4/30

[52] U.S. Cl. ..... 439/755; 439/504; 439/759

[58] Field of Search ..... 439/755, 759, 504

[56] References Cited

U.S. PATENT DOCUMENTS 3,745,516 7/1973 Lieberman ..... 439/755

4,620,767 11/1986 Woolf ..... 439/755

4,758,188 7/1988 Yates ..... 439/759

*Primary Examiner*—P. Austin Bradley

*Attorney, Agent, or Firm*—Salter & Michaelson

[57] ABSTRACT

A clamp for a battery booster cable that includes pivotally connected clamp members, each of which includes a handle portion to which a jaw portion is joined, the jaw portions of the clamp members being normally biased to a closed position and being movable to an open position for being mounted in clamping engagement on a terminal of a battery, the jaw portions of the clamp members being angularly disposed relative to the handle portions thereof, wherein the jaw portions are more easily clamped to a terminal of the battery.

3 Claims, 2 Drawing Sheets

CLAMP FOR BATTERY BOOSTER CABLE

BACKGROUND OF THE INVENTION

The present invention relates to a battery booster cable and more particularly relates to a clamp construction that is used in connection therewith.

Battery booster cables are employed by a user for electrically interconnecting a discharged battery of a stalled vehicle with a charged battery, normally located in another vehicle, for starting the stalled vehicle. In order to accomplish the interconnection of the batteries, the booster cable is provided with clamps on the ends thereof, a pair of the clamps being connected to a negative labeled cable, and another pair of clamps being connected to a positive labeled cable. Those clamps that are denoted as being secured to the positive cable are fixed to the corresponding battery terminals of the charged and discharged batteries as marked, and one of the negative clamps is connected to the negative terminal of the charged battery, and the opposite negative clamp is connected to a ground connection of the stalled vehicle.

Automobile batteries have been normally manufactured with the terminals located at the top thereof, wherein the positive and negative terminals of the battery are spaced apart. However, in recent times some manufactures of automobile batteries have constructed their batteries with at least one of the terminals located on the side thereof. Since the handle and jaw portions of the battery booster cable clamp in use heretofore are aligned, mounting the jaws of the clamp in place on a side-mounted terminal is sometimes difficult to accomplish. Some efforts have been made heretofore to modify the existing booster cable clamps by providing a slidable extension on the jaws of the clamp, the extension being moved outwardly of the jaws for use in engagement of the terminal as located on the side of the battery. However, this construction was not always satisfactory in use, since the extensions tended to bend in use, and were not always capable of establishing satisfactory electrical connection with the terminals on which they were mounted.

As will hereinafter be described, the subject invention avoids the problems of the heretofore known battery booster cable clamps, and is not only easily affixed to the side mounted battery terminals, but is also usable in an improved manner with top mounted battery terminals.

SUMMARY OF THE INVENTION

The present invention relates to a clamp for a battery booster cable for removable securement thereof to a terminal of a battery. The clamp includes a first pair of clamp members, each of which includes a handle portion to which a jaw portion is joined. The jaw portions of the clamp members are normally biased to a closed position by an internally located spring and are movable to an open position against the action of the spring for being mounted in clamping engagement on a terminal of a battery. The unique feature of applicant's invention is the forming of the jaw portions of the clamp members in angular disposition relative to the handle portions thereof. Thus, the angled jaw portions, when placed in contact with a top-mounted terminal cause the handle portions to extend upwardly in inclined relation with respect to the vertical so as to be more readily grasped by the user of the battery booster cable. When the clamp of the subject invention is to be secured to a side-mounted battery terminal, the clamp is located such that the jaw portions extend downwardly in inclined relation and are thus more easily attachable to the side terminal.

Accordingly, it is an object of the present invention to provide a clamp for a battery booster cable for removable securement to a terminal of a battery and that includes angularly disposed jaw portions that provide for the easy attachment of the jaw portions to the battery terminal.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
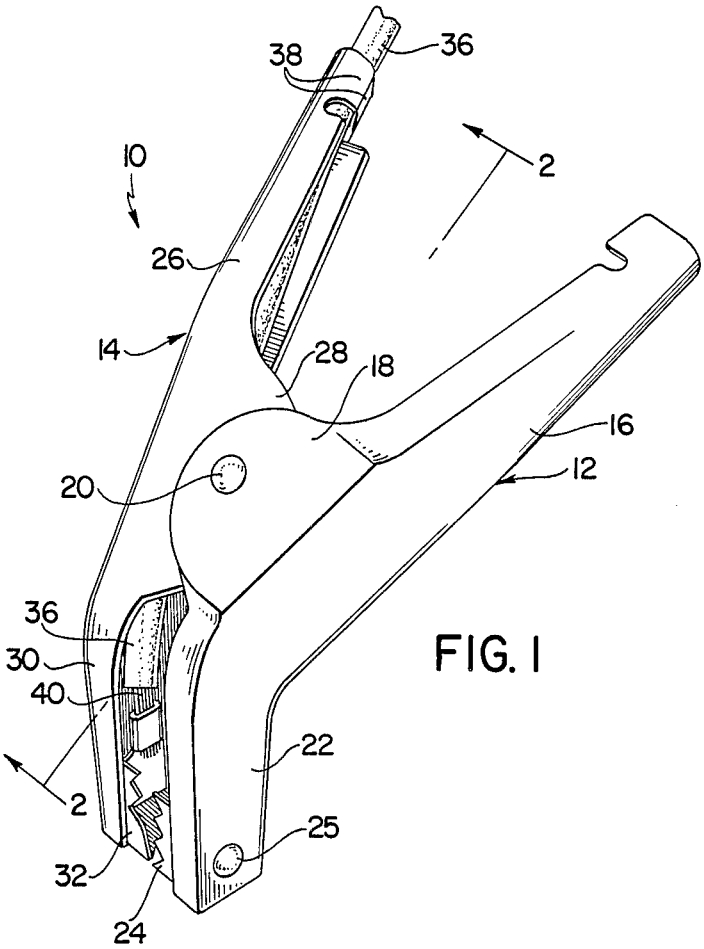
FIG. 1 is a perspective view of the battery booster cable of the subject invention.
Figure 2:
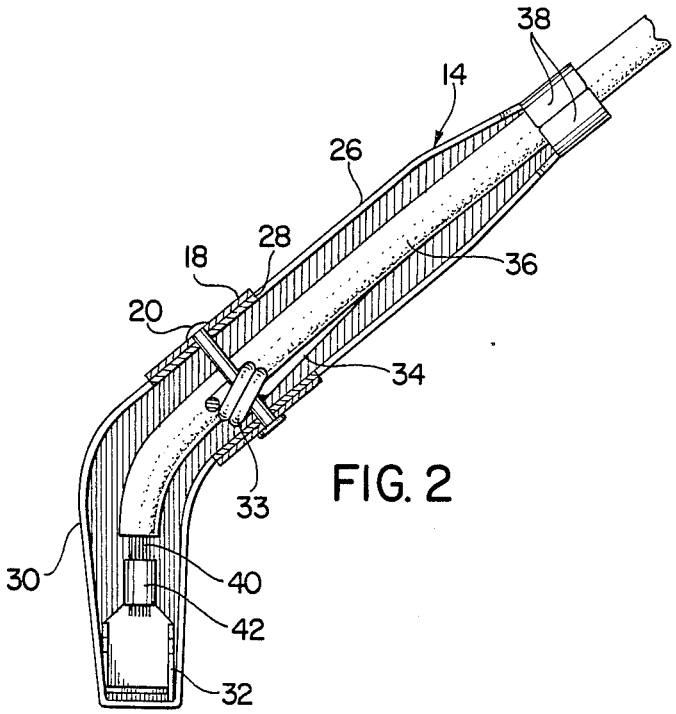
FIG. 2 is a sectional view taken along lines 2—2 in FIG. 1.

Referring now to the drawings, and particularly to FIGS. 1 and 2, the battery booster cable clamp of the subject invention is illustrated and is generally indicated at 10. The clamp 10 includes opposed clamp members generally indicated at 12 and 14, the clamp members 12 and 14 being formed of a relatively rigid metal material that is stamped and formed to the configuration as illustrated. The clamp members 12 and 14 may also be coated with a layer of an appropriate plastic-type material that provides for the protection thereof, as is well known in booster cable clamps.

The clamp member 12 includes a handle portion 16 that is formed with a longitudinally extending interior recess when the handle portion is conformed to the configuration as illustrated. Joined to the handle portion 16 on both sides thereof are inwardly extending enlarged projections 18 in which openings are formed for receiving a rivet 20. Integrally joined to the handle portion 16 is a jaw portion 22 which as shown is disposed in angular or inclined relation with respect to the handle portion, the angular configuration as defined by the handle portion 16 and jaw portion 22 forming an obtuse angle of approximately 135°. Preferably, the obtuse angle as formed by the junction of the handle and jaw portions is more than 90° but not more than 160°. Secured interiorly of the jaw portion 22 is a jaw element 24 that is fixed in place by a rivet 25 that extends through the lower end of the jaw portion. The jaw element is provided with serrated edges in the conventional manner that enables the jaw portion 22 to be securely clamped to the terminal of a battery as will be described.

The clamp member 14 also includes a handle portion 26 that is similar in construction to the handle portion 16 and is complementary thereto. Joined to both sides of the handle portion 26 are flat, laterally extending, enlarged projections 28 that underlie the complementary projections 18 and are secured thereto by the rivet 20 to pivotally connect the clamp members 12 and 14 together. A jaw portion 30 is also integrally joined to the handle portion 26 of the clamp member 14 and is angularly disposed with respect thereto in a manner similar to the jaw portion 22. The jaw portion 30 defines an obtuse angle with respect to the handle portion 26, and the angle as defined is in the range of more than 90° but less than 160° and is preferably approximately 135°. Secured to the interior portion of the jaw portion 30 is a jaw element 32 that is also formed with serrated edges, the jaw elements 24 and 32 cooperating to securely mount the clamp 10 on a battery terminal as will be further described. In order to bias the jaw portions 22 and 32 to the closed position as illustrated in FIG. 1, an interior spring 33 as shown in FIG. 2 is provided and is mounted on the rivet 20. The interior spring 33 is provided with legs 34 that extend into the interior recess portions of the handle portions 16 and 26 and cooperate to normally bias the jaw portions 22 and 30 to the closed positions thereof.

In order to electrically interconnect the clamp 10 to a battery terminal, a cable 36 is provided; and as shown in FIG. 1 and 2, is secured within the interior recess of the clamp member 14. For this purpose, the clamp member 14 is provided with foldable end tabs 38 that are folded around the insulation of the cable 36 to securely fix the cable to the clamp member 14. The adjacent end of the cable 36 is stripped to expose the strands 40 thereof, the strands 40 being securely fixed to the jaw element 32 at 42. It is understood that the manner in which the cable 36 is clamped to the cable member 14 is conventional in construction and does not form any part of the present invention. However, it is seen that the cable 36 is bent within the interior recess of the clamp member 14 to conform to the angular disposition of the jaw portion 30 relative to the handle portion 26.

It is understood that a second clamp member (not shown) is fixed to a complementary cable that is formed as part of the battery booster cable construction. Normally, one of the cables is designated as the negative cable and is joined to a clamp that is usually colored red to designate the negative cable. The corresponding clamp member (not shown) that is formed in a configuration similar to that illustrated in FIGS. 1 and 2, would in the illustration described be colored black to indicate the positive end of the cable and receives the cable in clamped position therein. The opposite ends of the cables also have clamps fixed thereto in the conventional manner and in accordance with the subject invention, the jaw portions thereof are angularly disposed relative to the handle portions as shown in FIGS. 1 and 2. With the complete cable construction thus formed as shown and described hereinabove, the battery booster cable is available for use for interconnecting a discharged battery to a charged battery for the purpose of energizing the discharged battery in the conventional manner.

Figure 3:
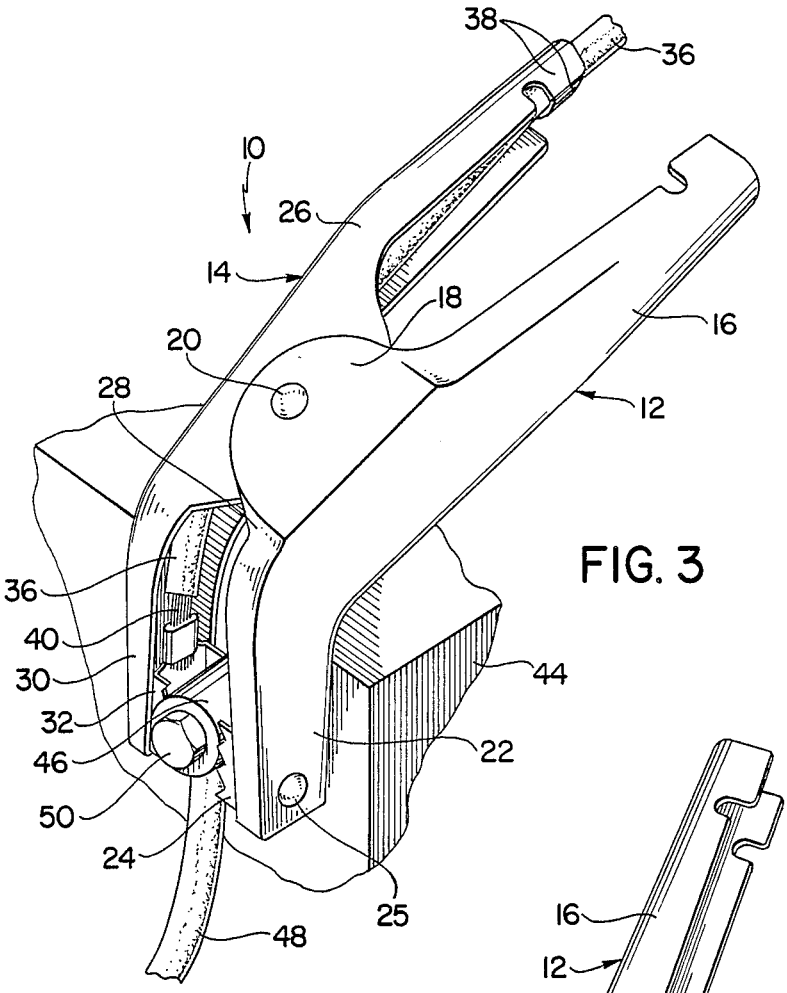
FIG. 3 is a perspective view showing the clamp of the subject invention as mounted on a side terminal of a battery.

As described hereinabove, the unique feature of applicant's invention resides in the relationship of the handle and jaw portions of the booster cable clamps. As shown in FIG. 3, a battery of conventional design is indicated at 44 and is provided with a side mounted terminal 46. A conventional battery cable 48 is connected to the terminal 46 through a bolt 50 which is also conventional in construction and use. As illustrated in FIG. 3, the booster cable clamp 10 is located such that the jaw portions 22 and 30 of the clamp members 12 and 14, respectively, are clamped to the terminal 46 by extending the jaw portions over the edge of the battery 44. In this connection, the user grasps the upwardly and angularly extending handle portions 16 and 26; and because of the inclined disposition of the jaw portions 22 and 30 relative to the handle portions 16 and 26, the jaw portions are easily secured to the terminal 46. Because the handle portions 16 and 26 extend angularly upwardly relative to the battery 44, the user can also safely grasp the handle portions 16 and 26 in mounting the clamp 10 in place and removing it from the terminal 46.

Figure 4:
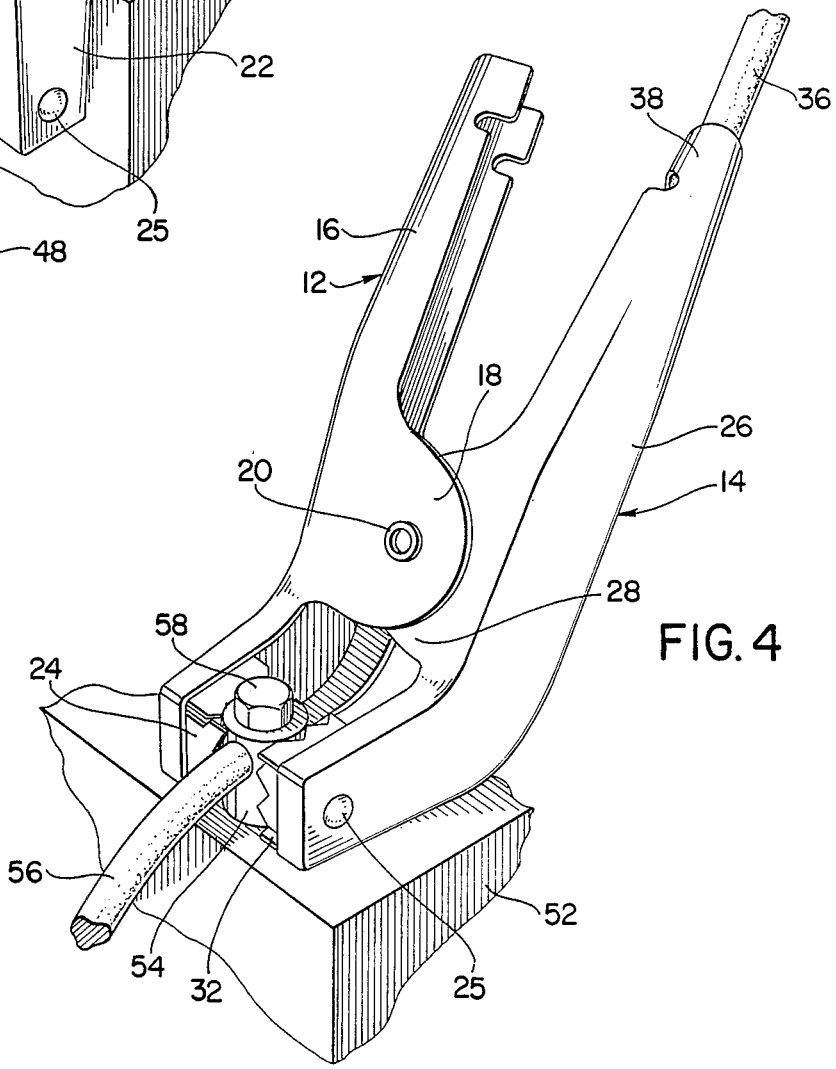
FIG. 4 is a perspective view of the cable of the subject invention as mounted on a top-located terminal of a battery.

Referring now to FIG. 4, a conventional battery illustrated at 52 is illustrated and includes a top-mounted terminal 54. A usual battery cable 56 is secured to the terminal 54 by a bolt 58. With the terminal 54 mounted on top of the battery 52, it is a simple matter to reverse the position of the clamp 10 from that illustrated in FIG. 3 so that the jaw portions 22 and 30 rest on top of the battery 52. In this position, the handle portions 16 and 26 extend angularly upwardly and also enable the user to easily manipulate the mounting of the jaw portions 22 and 30 into engagement with the terminal 54. After the discharged battery has been energized by the charged battery for starting a vehicle, the battery cable clamp 10 is easily removed from its mounted position by grasping the upwardly extending handle portions 16 and 26, squeezing them and then removing the clamp from its mounted position on the battery terminal 54.

It is seen that the clamp 10 of the subject invention is simple in construction, but is more effective in use than the previously known battery booster cable clamps because of the angular disposition of the jaw portions of the clamp relative to the handle portions thereof. Whether a side-mounted terminal or a top-mounted terminal is used on a battery, it is but a relatively simple matter to mount the clamp in place on the terminal, which enables the handle portions of the clamp to be located in an upwardly inclined position for ready access.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A clamp for a battery booster cable for removable securement to a terminal of a battery, comprising a pair of clamp members each of which includes a handle portion to which a jaw portion is joined, the jaw portions of said clamps being normally biased to a closed position and being movable to an open position for being mounted in clamping engagement on a terminal of a battery, the jaw portions of said clamp members being angularly disposed relative to the handle portions thereof wherein the jaw portions are more readily attachable to a terminal of said battery, each of said clamp members being formed in a one-piece construction of a metallic material and being bendable to an angular disposition to define the handle and clamp portions thereof.

2. A clamp as claimed in claim 1, each of the handle portions of said clamp members including a spaced-apart, enlarged portions, the corresponding enlarged portions of each handle portion overlapping and being pivotally secured together at pivot connections, said pivot connections being located adjacent to the jaw portions of said clamp members.

3. A clamp for a battery booster cable for removable securement to a terminal of a battery, comprising a pair of clamp members each of which includes a handle portion to which a jaw portion is joined, the jaw portions of said clamps being normally biased to a closed position and being movable to an open position for being mounted in clamping engagement on a terminal of a battery, the jaw portions of said clamp members being angularly disposed relative to the handle portions thereof wherein the jaw portions are more readily attachable to a terminal of said battery, the angle between said handle portion and jaw portion of each clamp member providing for secure attachment of said jaw portions on the battery terminal as mounted on the top of the battery, the handle portions of said clamp members extending upwardly and angularly over the top of the battery for easy manipulation by the user of said battery booster cable.

* * * * *